US012624558B2

(12) United States Patent
D'Amico et al.

(10) Patent No.: US 12,624,558 B2
(45) Date of Patent: May 12, 2026

(54) MODULAR DOZER PLATFORM

(71) Applicant: MINE RITE TECHNOLOGIES, LLC, Buffalo, WY (US)

(72) Inventors: John A. D'Amico, Story, WY (US); Zachary A. D'Amico, Sheridan, WY (US)

(73) Assignee: Mine Rite Technologies, LLC, Buffalo, WY (US)

( * ) Notice: Subject to any disclaimer, the term of this patent is extended or adjusted under 35 U.S.C. 154(b) by 1305 days.

(21) Appl. No.: 17/445,151

(22) Filed: Aug. 16, 2021

(65) Prior Publication Data

US 2023/0047583 A1 Feb. 16, 2023

(51) Int. Cl.
*E04G 1/24* (2006.01)
*E04G 5/14* (2006.01)

(52) U.S. Cl.
CPC ..... *E04G 1/24* (2013.01); *E04G 5/14* (2013.01); *E04G 2001/242* (2013.01)

(58) Field of Classification Search
CPC ..... E04G 1/24; E04G 5/14; E04G 2001/242; E21F 17/00; B64F 5/10; B64F 5/40; B64F 5/60
See application file for complete search history.

(56) References Cited

U.S. PATENT DOCUMENTS 3,698,511 A * 10/1972 Dohan ..... E04G 1/14 182/119
3,831,709 A * 8/1974 Stanford ..... B64F 5/60 180/125
4,782,914 A * 11/1988 Nail ..... E04G 5/14 182/113
4,787,111 A * 11/1988 Pacek ..... B65G 69/22 49/369
5,255,758 A * 10/1993 Hood, Jr. ..... E06C 7/185 182/186.8
6,772,860 B1 * 8/2004 Nelson ..... E04G 1/24 182/115

(Continued)

FOREIGN PATENT DOCUMENTS

CA 2629578 A1 * 10/2009 ..... E04G 1/36
CN 207671645 U * 7/2018

(Continued)

OTHER PUBLICATIONS

International Search Report and Written Opinion dated Jan. 12, 2022 issued in PCT App. No. PCT/US2021/071199 (16 pages).

(Continued)

*Primary Examiner* — Brian D Mattei
*Assistant Examiner* — Kathleen M. McFarland
(74) *Attorney, Agent, or Firm* — Haynes and Boone, LLP; Robert P. Ziemian

(57) ABSTRACT

The disclosed modular dozer platform provides systems and methods for safely accessing a platform for mounting a mobile piece of mining equipment. The disclosed systems and methods comprise a platform with modular frame, a plurality of ground engaging members supporting the frame and one or more sets of stairs providing access to the modular frame. In practice, the mobile piece of mining equipment is positioned in a central location and the modular frame sections are positioned around the mobile piece of mining equipment.

19 Claims, 7 Drawing Sheets

(56) References Cited

U.S. PATENT DOCUMENTS 6,830,127 B2 * 12/2004 Johnson ..... E02D 29/12 182/128
8,235,126 B2 * 8/2012 Bradley ..... E21B 41/00 166/75.11
8,733,738 B2 * 5/2014 Mun ..... B23P 21/00 254/122
9,259,639 B2 * 2/2016 Davis ..... E04F 11/002
9,441,382 B2 * 9/2016 Hokanson ..... E06C 7/182
10,145,129 B2 * 12/2018 Bains ..... E04G 5/02
10,267,122 B2 * 4/2019 Toma ..... E21B 41/00
10,358,871 B2 * 7/2019 Honeycutt ..... E04G 7/02
10,724,256 B1 * 7/2020 Anderson ..... E06C 1/39
10,858,893 B2 * 12/2020 Toma ..... E21B 41/00
11,441,321 B2 * 9/2022 Fleming ..... B64F 5/40
2003/0178253 A1 * 9/2003 Tatge ..... E04G 5/061 182/132
2004/0040784 A1 * 3/2004 Johnson ..... E02D 29/12 182/113
2005/0167195 A1 * 8/2005 Chipman ..... E04G 5/14 182/17
2006/0059636 A1 * 3/2006 Suggate ..... E04G 1/152 14/69.5
2007/0051559 A1 * 3/2007 Brown ..... B66F 11/042 182/63.1
2010/0089699 A1 * 4/2010 Meltz ..... E04G 1/24 182/222
2011/0198153 A1 * 8/2011 Dufour ..... E04G 27/00 182/113
2011/0253476 A1 * 10/2011 Earl ..... B66F 7/02 182/69.6
2012/0024629 A1 * 2/2012 Berry, Jr. ..... A01D 46/20 182/113
2012/0036700 A1 * 2/2012 Mun ..... B64F 5/10 182/62.5
2012/0073902 A1 * 3/2012 Honeycutt ..... E04G 1/17 182/113
2013/0233646 A1 * 9/2013 Boysaw ..... E04G 1/24 182/115
2013/0319796 A1 * 12/2013 Davis ..... E04H 3/28 14/71.1
2014/0262619 A1 * 9/2014 Bains ..... E04G 7/34 248/351
2015/0166198 A1 * 6/2015 Hokanson ..... E06C 1/12 182/101
2015/0211234 A1 * 7/2015 Lanphear ..... E04F 11/06 52/183
2016/0237702 A1 * 8/2016 Micklan ..... E04G 3/243
2017/0292349 A1 * 10/2017 Toma ..... E04G 1/24
2019/0017281 A1 * 1/2019 Luna ..... E04G 5/10
2020/0270107 A1 * 8/2020 Hokanson ..... E04G 1/18
2021/0025181 A1 * 1/2021 Anderson ..... E06C 1/397
2021/0095482 A1 * 4/2021 Fleming ..... E04G 1/24
2023/0047583 A1 * 2/2023 D'Amico ..... E21F 17/00
2025/0012100 A1 * 1/2025 Rogers ..... E04C 3/005
2025/0092674 A1 * 3/2025 Scrafford ..... E04G 5/14
2025/0092693 A1 * 3/2025 Frame ..... E04G 5/14

FOREIGN PATENT DOCUMENTS

CN 110065650 A * 7/2019 ..... B25H 1/16
CN 110778091 A * 2/2020
CN 110984547 A * 4/2020
CN 111851976 A * 10/2020
CN 116080926 A * 5/2023
GB 2374894 A * 10/2002 ..... E04G 1/15
KR 20100017055 A * 2/2012 ..... E04G 1/24
KR 101829661 B1 * 3/2018

OTHER PUBLICATIONS

Layher. "Layher Allround Ultimate Scaffolding Package". . . (online). Dec. 1, 2017; (Retrieved on Oct. 14, 2021). Retrieved from the Internet: URL: <https://www.scaffoldusa.com/modular-scaffolding/layher-allround-ultimate-scaffolding-package, pp. 1-4.

Office Action mailed on Jul. 9, 2025 for related Canadian Patent Application No. 3229364 (8 pages).

* cited by examiner

MODULAR DOZER PLATFORM

TECHNICAL FIELD

The present disclosure relates to modular platform systems and methods for accessing a mobile piece of mining equipment, and more particularly to systems and methods for safely maintaining mobile pieces of mining equipment via modular platforms.

BACKGROUND OF THE INVENTION

Those skilled in the art of mining, and more specifically those familiar with using and maintaining mining equipment, will appreciate that many existing mining machines do not include an easy way to access on board componentry, such as, for example, the engine or other operating systems. At best, many machines only include a step or ladder, commonly associated with a hand rail or grip, as the only method of access for operators to the engine/control station of the machine. Some operating systems contain no easy way of access at all. Moreover, in many instances, the engine/control station may be elevated many feet from ground level. Also, before operation of such machines, it is sometimes necessary for operators to check the position or status of certain components of the machine, such as drive wheels, earth-working implements or other machine subsystems, relative to geographical features or man-made obstacles that the machine may encounter during operation. This is especially the case when the extremities of such components are not clearly visible from the control station.

Accessing componentry on these machines may expose operators to the risk of a fall. Accordingly, there is a risk of injury to the operator should he/she slip or fall when climbing to a control station or standing in a precarious position elevated on the machine. This risk is multiplied where the machine includes earth working implements with sharp edges or teeth, such as excavator buckets, grader blades or earth ripping tines, in the path of a potential fall. Machine operators have previously suffered serious injuries, including debilitating and potentially fatal head injuries, during falls of this nature. Maintenance personnel and operators face similar risks when access to the engine or other operating systems, such as hydraulic lines or bearings, is required for inspection, cleaning or lubrication purposes. It is with these known deficiencies in the art that the present invention was conceived.

SUMMARY OF THE INVENTION

Accordingly, one object of the present invention discloses a system and method that allows for safe access to key maintenance points on a dozer or another piece of mobile mining equipment. The present invention eliminates the need to tie off, i.e. use of safety belts and lines in order to prevent falls and/or other accidents. The present invention is designed for any type of dozer or other piece of mobile mining equipment and is complete with a full PE (professional engineer) certification. The present invention allows direct access to key maintenance components. Rather than having to crawl on the dozer and awkwardly position yourself to work (i.e. on track), the present invention allows for safe work platforms that are located in direct conjunction with the primary areas where work is performed. This not only is much safer than the present options available in the art, but it also allows the technicians to be more efficient in their job performance. The present invention also eliminates the "Fall Protection" requirements, (i.e. Mine Safety and Health Administration ("MSHA") standards at 30 C.F.R. §§ 56/57 require that safety belts and lines be worn when persons work where there is a danger of falling. A second person must also tend the lifeline when bins, tanks or other dangerous areas are entered. Furthermore, each employee on a walking/working surface (horizontal and vertical surface) with an unprotected side or edge which is 6 feet or more above a lower level shall be protected from falling by the use of guardrail systems, safety systems, or personal fall arrest systems). Typically performing maintenance tasks on dozers at a mine site requires significant fall protection requirements due to the constraints of the areas available to work. The present invention allows direct and handrailed access to key maintenance areas thus eliminating (most) fall protection requirements. Fall protection is an item that is a high priority for mine sites to eliminate whenever possible.

The present invention also allows complete access to the dozer. The present invention encircles the dozer completely, allowing technicians to complete all work from the platforms and without having to leave the platforms. Consequently, this increases safe work practices as well as increases efficiency of work. For example, to get from one side of the dozer to the other, a user simply may walk around the joined platforms rather than mount/dismount a ladder positioned to a specific area.

The modular design of the present invention also allows for the various platforms to be easily and compactly stored and allows for use in multiple shop work areas, when applicable. This allows the platform to be mobilized and demobilized based on the work area. The modular design also allows users to utilize the platform throughout the entire workplace rather than a dedicated location. The present invention also eliminates the need for free standing ladders at the mine site. Ladders become a safety hazard pertaining specifically to falling. Typically, ladders are a key item used during the maintenance of dozers. The Modular Dozer Platform promotes the elimination of ladders by utilizing stair access to the modular platforms.

In preferred embodiments, the present invention discloses a modular access platform for mounting on a mobile piece of mining equipment with a modular frame, a plurality of ground engaging members supporting the frame, and one or more sets of stairs providing access to the modular frame. In practice, the mobile piece of mining equipment is positioned in a central location and the modular frame sections are positioned around the mobile piece of mining equipment.

The present invention also discloses a method of accessing a mobile piece of mining equipment. In some preferred embodiments, this method includes positioning the mobile piece of mining equipment centrally within a substantially level location, positioning a modular access platform around the mobile piece of mining equipment and locking the plurality of locking mechanisms on the plurality of wheels. In these preferred embodiments, the method also includes mechanically coupling the first side deck sections to the front deck section, mechanically coupling the second side deck sections to the first side deck sections, mechanically coupling the third side deck section to the second side deck sections, mechanically coupling the fourth side deck sections to the third side deck sections, and mechanically coupling the rear deck sections to the fourth side deck sections. Two sets of stairs are then positioned on both sides of the front deck section, which are then mechanically coupled to the two sets of stairs on the first side sections and the front deck section, thereby providing access to the modular frame by a user. In some preferred embodiments, the described method is used to provide maintenance to, to clean or to physically inspect a mobile piece of mining equipment.

The Summary is neither intended nor should it be construed as being representative of the full extent and scope of the present disclosure. The present disclosure is set forth in various levels of detail in the Summary, as well as in the attached drawings and the Detailed Description, and no limitation as to the scope of the present disclosure is intended by either the inclusion or non-inclusion of elements, components, etc. in this Summary. Additional aspects of the present disclosure will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present disclosure are possible utilizing, alone or in combination, as set forth above and/or described in the accompanying figures and/or in the description herein below. Further details and other features will become apparent after review of the following Detailed Description and accompanying drawing figures.

BRIEF DESCRIPTION OF THE DRAWINGS

Example embodiments are illustrated in referenced figures of the drawing. It is intended that the embodiments and figures disclosed herein are to be considered illustrative rather than limiting.

Figure 1:
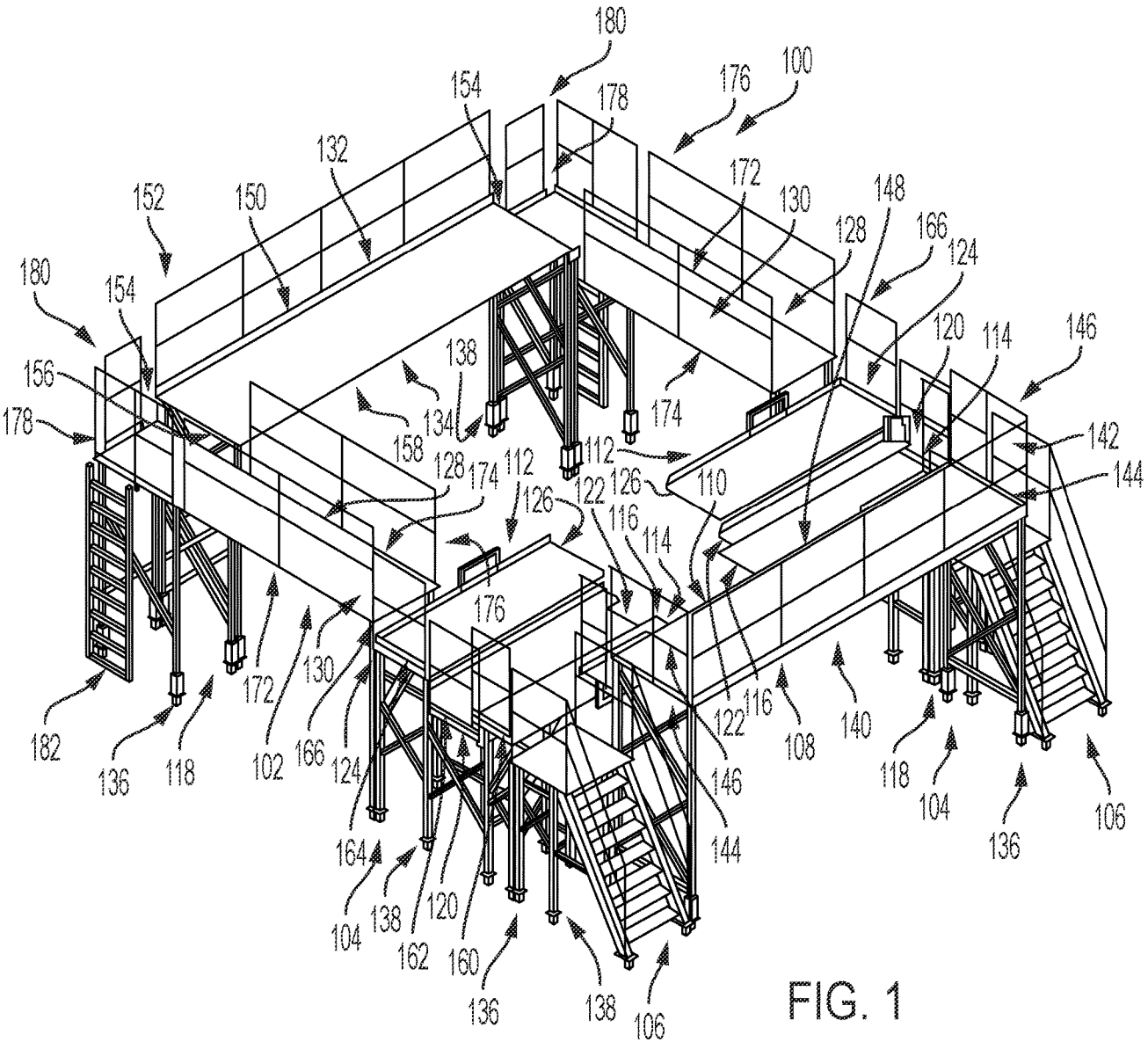
FIG. 1 discloses an overhead view of the modular access platform according to a preferred embodiment.
Figure 2:
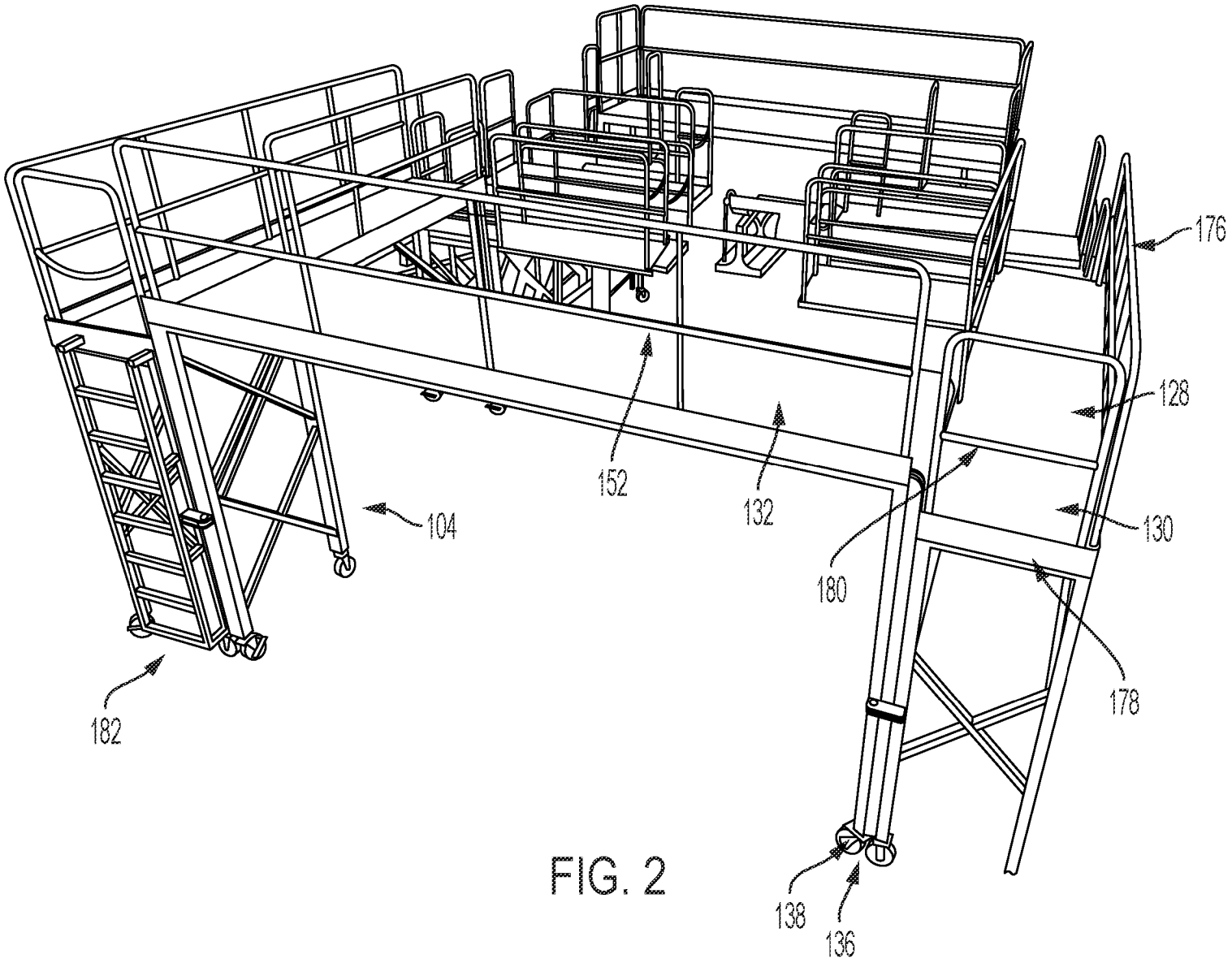
FIG. 2 discloses an overhead view of the modular access platform according to a preferred embodiment.
Figure 3:
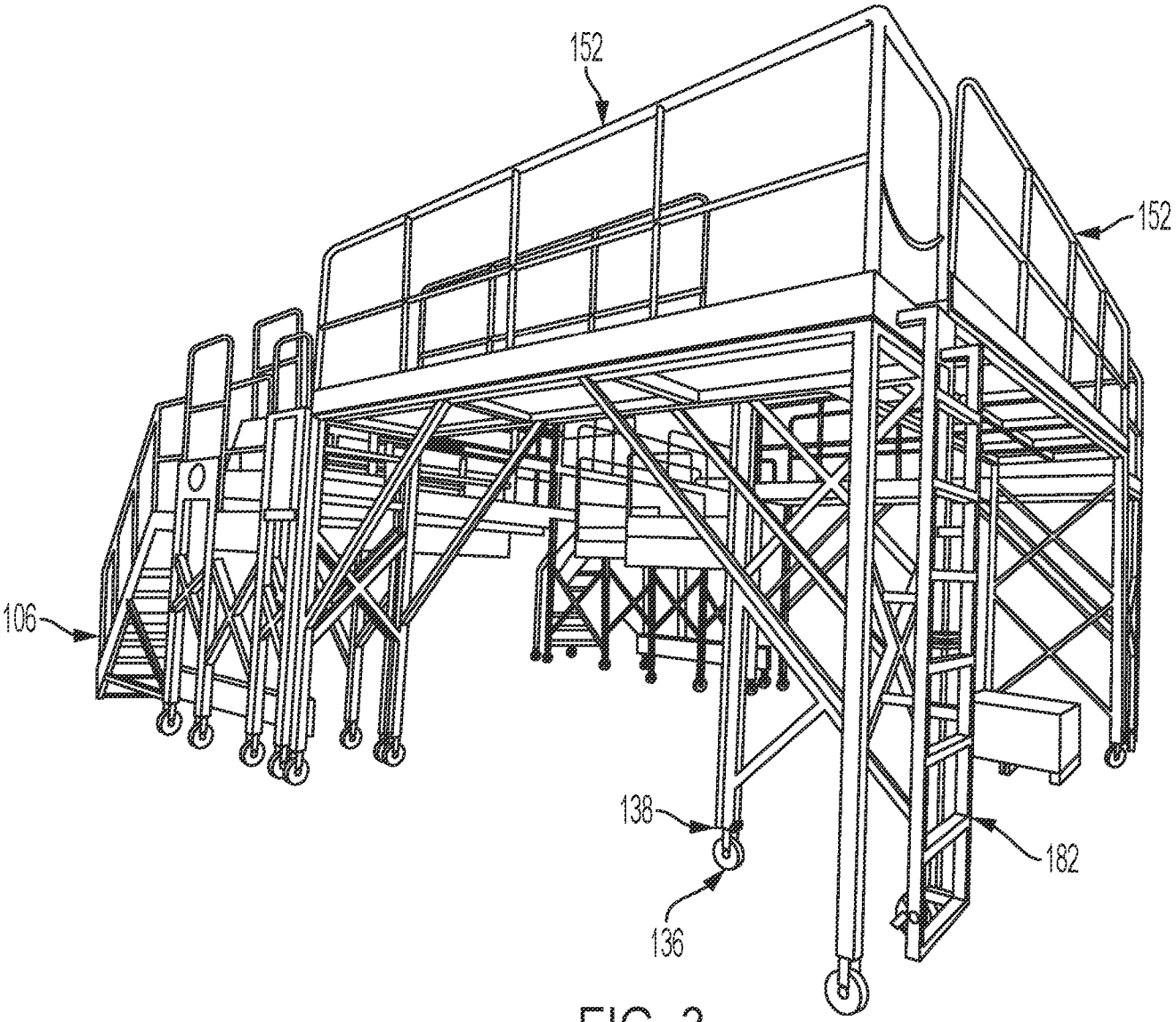
FIG. 3 discloses a side view of the modular access platform according to a preferred embodiment.
Figure 4:
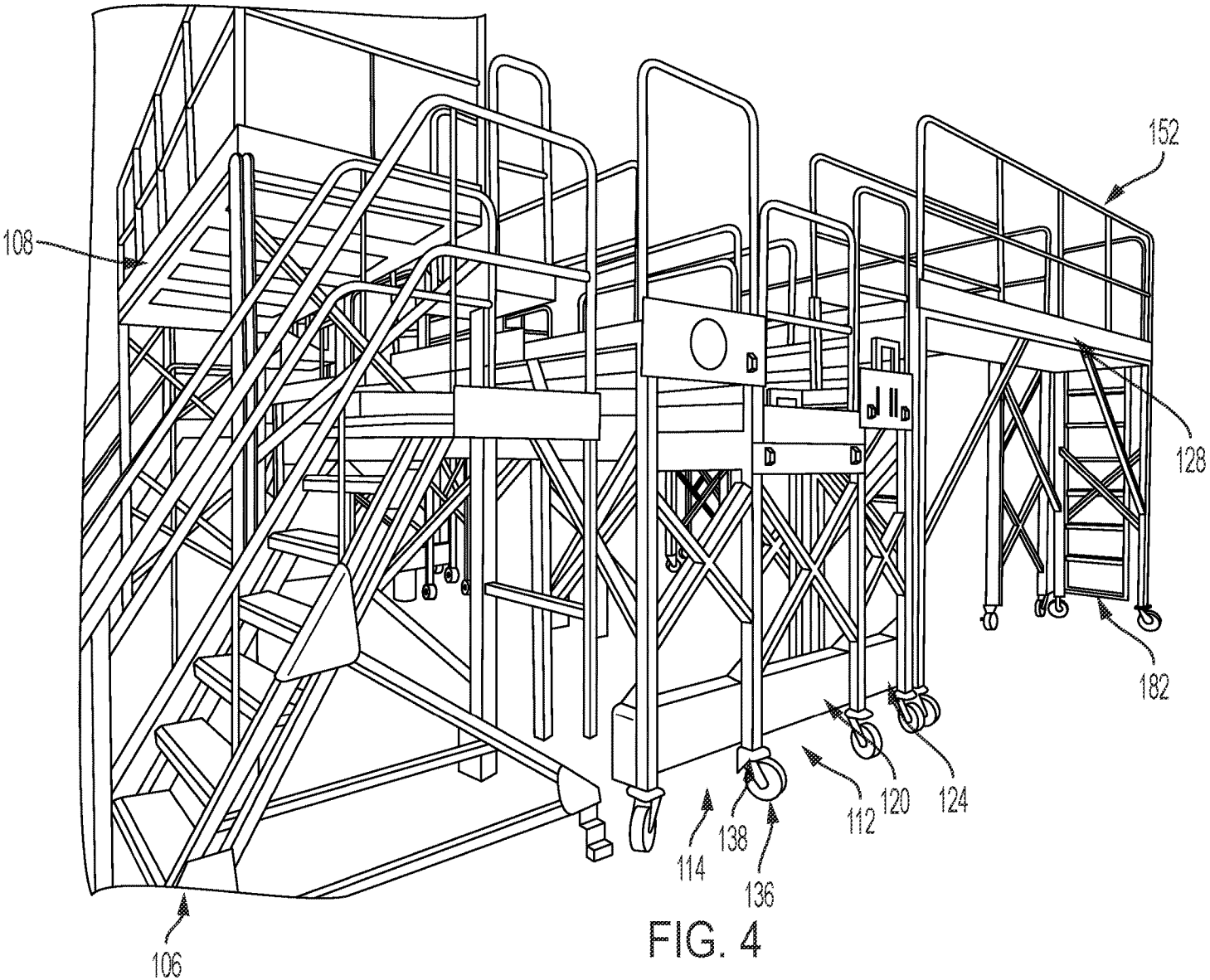
FIG. 4 discloses a side view of the modular access platform according to a preferred embodiment.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

DETAILED DESCRIPTION

The present invention provides its benefits across a broad spectrum of endeavors. It is applicant's intent that this specification and the claims appended hereto be accorded a breadth in keeping with the scope and spirit of the invention being disclosed despite what might appear to be limiting language imposed by the requirements of referring to the specific examples disclosed. Thus, to acquaint persons skilled in the pertinent arts most closely related to the present invention, a preferred embodiment of the system is disclosed for the purpose of illustrating the nature of the invention. The exemplary method of installing, assembling and operating the system is described in detail according to the preferred embodiment, without attempting to describe all of the various forms and modifications in which the invention might be embodied. As such, the embodiments described herein are illustrative, and as will become apparent to those skilled in the art, can be modified in numerous ways within the scope and spirit of the invention, the invention being measured by the appended claims and not by the details of the specification.

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent using the sentence "As used herein, the term '_____' is hereby defined to mean '_____' or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, subparagraph (f).

Figure 5:
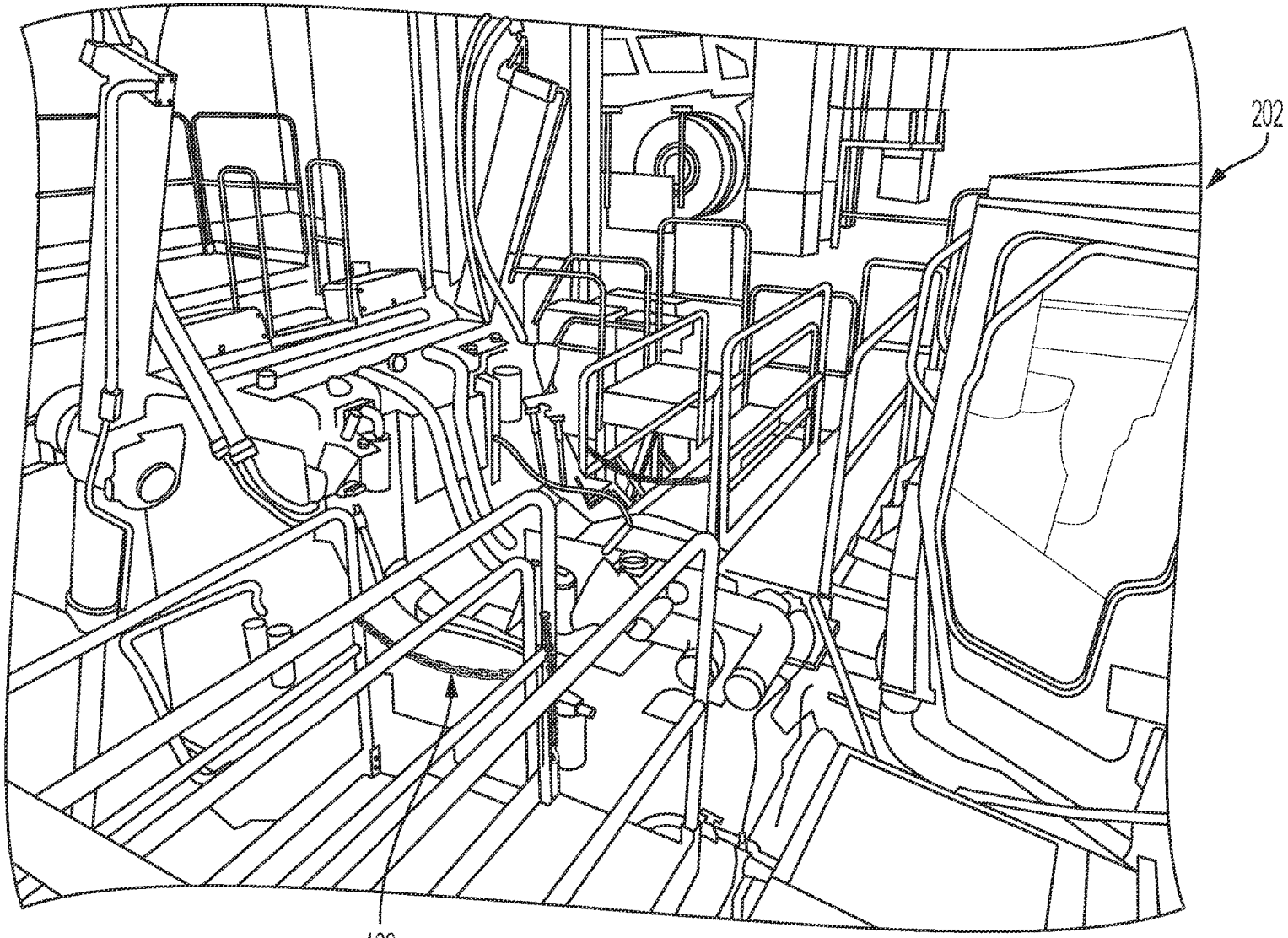
FIG. 5 discloses an overhead view of the modular access platform while surrounding a mobile piece of mining equipment according to a preferred embodiment.

In preferred embodiments, the modular dozer platform provides systems and methods for providing direct access to key maintenance components on a piece of mobile mining equipment. In some embodiments, the modular dozer platform is made from steel. Referring now to the drawings, FIGS. 1-5 disclose a modular access platform 100 for mounting on a mobile piece of mining equipment 202 (shown in FIG. 5) with a modular frame 102 a plurality of ground engaging members supporting the frame 104 and one or more sets of stairs providing access to the modular frame 106. In practice, the mobile piece of mining equipment 202 is positioned in a central location and the modular frame 102 sections are positioned around the mobile piece of mining equipment as explained in more detail below.

In some preferred embodiments, the modular frame 102 includes a modular front deck section 108 with at least one front access location 110 that provides access to the front of the mobile piece of mining equipment 202. The modular frame also includes two modular side deck sections 112, each side deck section comprising a first side deck 114 with at least one side access location 116 that provides access to the side of the mobile piece mining equipment 202. The first side deck 114 section may be mechanically coupled to the front deck section 108 via connectors 118. In these preferred embodiments, a second side deck section 120 is positioned lower in height than the first side deck section 114 and includes at least one side access location 122 that provides access to the side of the mobile piece mining equipment 202. The second side deck section 120 may be mechanically coupled to the first side deck section 114 via connectors 118. A third side deck section 124 is positioned higher in height than the second side deck section 120 and includes at least one side access location 126 that provides access to the side of the mobile piece mining equipment 202. The third side deck section may be mechanically coupled to the second side deck section 120 via connectors 118. A fourth side deck section 128 provides a side walkway portion 130 that may connect the third side deck section 124 to a rear deck section 132. The rear deck section 132 has at least one rear access location 134 that provides access to the rear of the mobile piece mining equipment 202.

In some preferred embodiments, the plurality of ground engaging members 104 on the modular access platform 100 contains a plurality of wheels 136 that can be locked into place or unlocked in order to move a section of the modular frame 102 via a plurality of locking mechanisms 138. In some preferred embodiments, the wheels 136 comprise high durometer casters. When the plurality of locking mechanisms 138 on the plurality of wheels 136 are unlocked, sections of the modular frame 102 can be manually moved. When the plurality of locking mechanisms 138 on the plurality of wheels 136 are locked, the modular frame becomes stationary, either, for example, when positioned around a mobile piece of mining equipment 202 or when stored and not in use.

In some preferred embodiments, the front deck section 108 of the modular frame 102 is substantially rectangularly shaped and further comprises a front end 140 that is mechanically coupled to a plurality of safety barriers 142. In some preferred embodiments, these safety barriers 142 comprise handrailing that eliminates the need to tie off and also eliminates the risk of falling off the modular frame 102. In these preferred embodiments, the front deck section 108 also contains two side ends 144, which are mechanically coupled to a plurality of side safety barriers 146, and a back end 148 that provides at least one front access location 110 to the front of the mobile piece mining equipment 202.

In some preferred embodiments, the rear deck section 132 of the modular frame 102 is substantially rectangularly shaped and further comprises a back end 150 that is mechanically coupled to a plurality of safety barriers 152. In these preferred embodiments, the rear deck section 132 also contains two side ends 154 that provide access to the walkway portion 130 of the fourth side deck 128. In some embodiments, the two side ends 154 of the rear deck section 132 provide a step down 156 to the walkway portion 130 of the fourth side deck 128. The rear deck section 132 also contains a front end 158 that provides at least one front access location 134 to the back of the mobile piece mining equipment 202.

In some preferred embodiments, the two side deck sections 112, and more specifically the first side deck 114, second side deck 120, and third side deck 124 all contain outside edges (160, 162 and 164 respectively) that are mechanically coupled to safety barriers 166. In some embodiments, the inside edges i.e. first side access 116, second side access 122 and third side access 126, of first side deck 114, second side deck 120, and third side deck 124, contain removable safety barriers 168, such as, for example, removable chains (as shown most clearly in FIG. 5) that allow a user to take down the safety barrier when the user is providing maintenance to that section of the mobile piece of mining equipment 202. In some preferred embodiments, the fourth side deck 128 is substantially rectangular shaped and contains a front end 172 that provides a step down to the third side deck 124. The fourth side deck 128 also contains an outside edge portion 172 and an inside edge 174 that are mechanically coupled to safety barriers 176. The fourth side deck 128 also contains back end 178 that is mechanically coupled to safety barriers 180. Rear fourth side deck. The fourth side deck 128 also contains one or more escape ladders 182 that allows a user to climb off the modular frame 102 if he or she needs to and cannot access the one or more sets of stairs 106 located on the other side of the modular access platform 100.

Figure 6A:
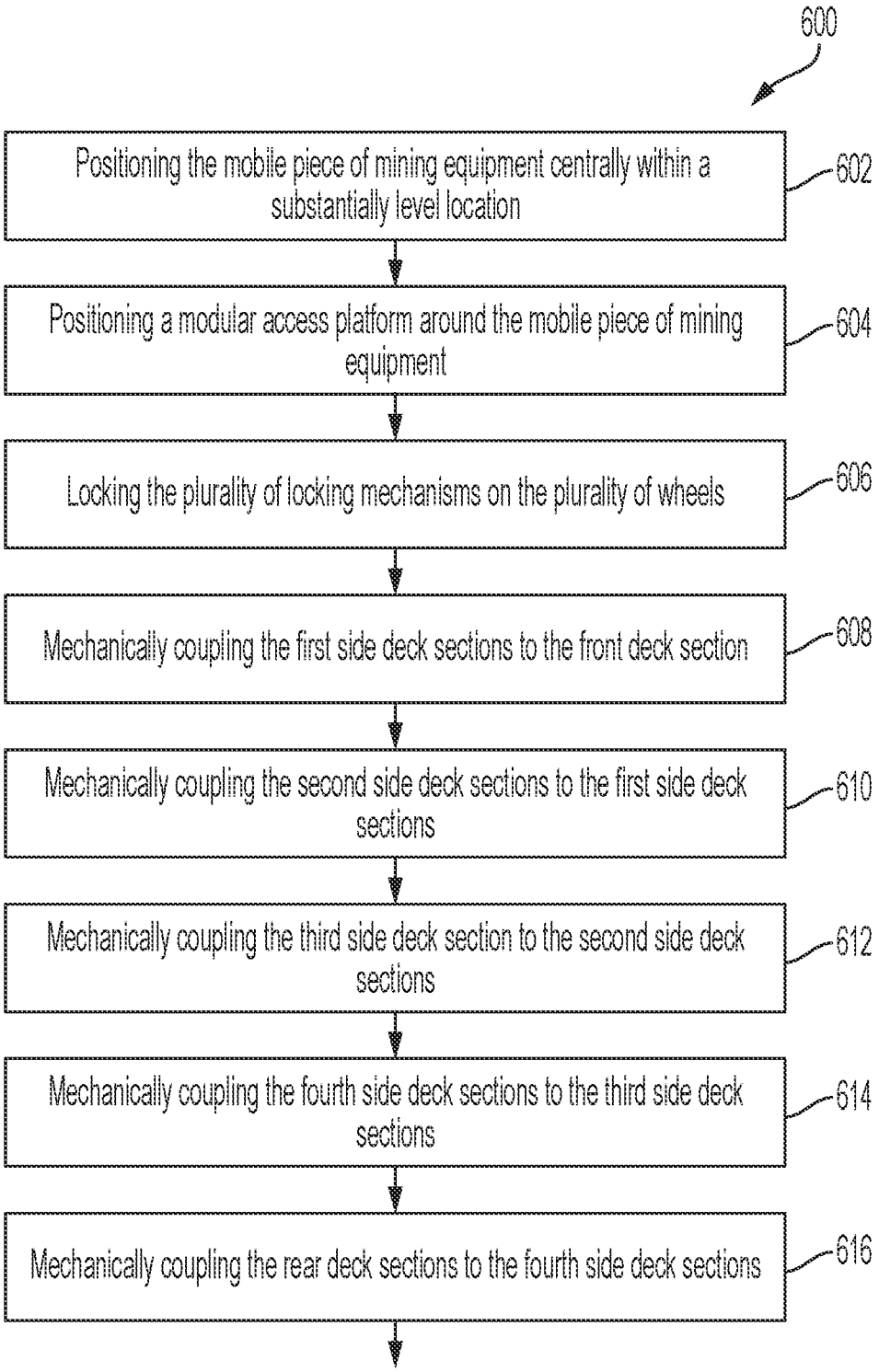
FIGS. 6A and 6B disclose a method of accessing a mobile piece of mining equipment according to a preferred embodiment.
Figure 6B:
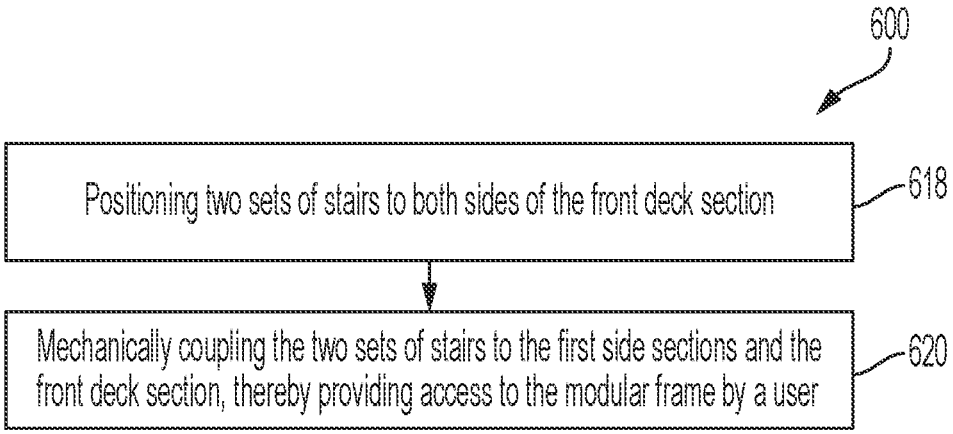

Now referring to FIG. 6, the present invention also discloses a method of accessing a mobile piece of mining equipment 600 comprising positioning the mobile piece of mining equipment centrally within a substantially level location 602, positioning a modular access platform around the mobile piece of mining equipment 604, locking the plurality of locking mechanisms on the plurality of wheels 606, mechanically coupling the first side deck sections to the front deck section 608, mechanically coupling the second side deck sections to the first side deck sections 610, mechanically coupling the third side deck section to the second side deck sections 612, mechanically coupling the fourth side deck sections to the third side deck sections 614, mechanically coupling the rear deck sections to the fourth side deck sections 616, positioning two sets of stairs to both sides of the front deck section 618; and mechanically coupling the two sets of stairs to the first side sections and the front deck section, thereby providing access to the modular frame by a user 620. In some preferred embodiments, the described method is used to provide maintenance to, to clean or to physically inspect a mobile piece of mining equipment 202.

All directional references (e.g. top, bottom, front, back) are only used for identification purposes to aid the reader's understanding of the embodiments of the present invention, and do not create limitations, particularly as to the position, orientation, or use of the invention unless specifically set forth in the claims. Joinder references (e.g. attached, coupled, connected, and the like) are to be construed broadly and may include intermediate members between a connection of elements and relative movement between elements. As such, joinder references do not necessarily infer that two elements are directly connected and in fixed relation to each other.

The above-described benefits, embodiments, and/or characterizations are not necessarily complete or exhaustive, and in particular, as to the patentable subject matter disclosed herein. Other benefits, embodiments, and/or characterizations of the present invention are possible utilizing, alone or in combination, as set forth above and/or described in the accompanying figures and/or in the description herein below.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and drawing figures are to be understood as being approximations which may be modified in all instances as required for a particular application of the novel assembly and method described herein.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description and in the appended drawing figures.

In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed:

1. A modular platform system for accessing a mobile piece of mining equipment comprising:

a modular frame;

one or more sets of stairs providing access to the modular frame, wherein the modular frame comprises:

a modular front deck section with at least one front access location that provides access to the front of the mobile piece of mining equipment;

a first modular side deck section comprising a first side deck with at least one side access location that provides access to the side of the mobile piece of mining equipment, wherein the first modular side deck section is separately movable from the front deck section and mechanically couplable to the front deck section;

a second modular side deck section with at least one side access location that provides access to the side of the mobile piece of mining equipment, wherein the second modular side deck section is separately movable from the first side deck section and mechanically couplable to the first side deck section;

a third modular side deck section with at least one side access location that provides access to the side of the mobile piece of mining equipment, wherein the third modular side deck section is separately movable from the second side deck section and mechanically couplable to the second side deck section;

a fourth modular side deck section that is separately movable from the third side deck section and a rear modular deck section and provides a side walkway portion connectable to the third side deck section and the rear deck section; and the rear deck section with at least one rear access location that provides access to the rear of the mobile piece of mining equipment, wherein the rear deck section is separately movable from and mechanically couplable to the fourth side deck section; and a plurality of ground engaging members supporting the frame, wherein the plurality of ground engaging members further comprise a plurality of wheels with a plurality of locking mechanisms, such that each of the modular front deck section, the first modular side deck section, the second modular side deck section, the fourth modular side deck section, and the rear deck section are separately movable on the plurality of wheels.

2. The modular platform system of claim 1, wherein when the plurality of locking mechanisms on the plurality of wheels are unlocked, the front, first side, second side, third side, fourth side, and rear sections of the modular frame can be manually moved.

3. The modular platform system of claim 1, wherein when the plurality of locking mechanisms on the plurality of wheels are locked, the modular frame becomes stationary.

4. The modular platform system of claim 1, wherein the front deck section of the modular frame is substantially rectangularly shaped and further comprises:

a front end that is mechanically coupled to a plurality of safety barriers;

two side ends both mechanically coupled to a plurality of safety barriers; and a back end that provides at least one front access location to the front of the mobile piece mining equipment.

5. The modular platform system of claim 1, wherein the rear deck section of the modular frame is substantially rectangularly shaped and further comprises:

a back end that is mechanically coupled to a plurality of safety barriers;

two side ends that provide access to the walkway portion of the fourth side deck; and a front end that provides at least one front access location to the back of the mobile piece mining equipment.

6. The modular platform system of claim 1, wherein the two side deck sections further comprise a plurality of safety barriers that are permanently affixed.

7. The modular platform system of claim 1, wherein the two side deck sections further comprise a plurality of safety barriers that may be removeable by a user.

8. The modular platform system of claim 1, wherein the rear deck section further comprises one or more escape ladders.

9. The modular platform system of claim 1, wherein the modular frame is made from galvanized steel.

10. A method of accessing a mobile piece of mining equipment comprising:

positioning the mobile piece of mining equipment centrally within a substantially level location;

assembling a modular access platform around the mobile piece of mining equipment, wherein the modular access platform comprises:

a modular frame comprising:

a modular front deck section with at least one front access location that provides access to the front of the mobile piece of mining equipment;

a first modular side deck section comprising a first side deck with at least one side access location that provides access to the side of the mobile piece of mining equipment, wherein the first modular side deck section is separately movable from the front deck section and mechanically couplable to the front deck section;

a second modular side deck section with at least one side access location that provides access to the side of the mobile piece of mining equipment, wherein the second modular side deck section is separately movable from the first side deck section and mechanically couplable to the first side deck section;

a third modular side deck section with at least one side access location that provides access to the side of the mobile piece of mining equipment, wherein the third modular side deck section is separately movable from the second side deck section and mechanically couplable to the second side deck section;

a fourth side deck section that is separately movable from the third side deck section and a rear modular deck section and provides a side walkway portion connectable to the third side deck section and the rear deck section; and the rear deck section with at least one rear access location that provides access to the rear of the mobile piece of mining equipment, wherein the rear deck section is separately movable from and mechanically couplable to the fourth side deck section;

a plurality of ground engaging members supporting the frame; and a plurality of wheels affixed to the distal end of the plurality of ground engaging members, wherein the plurality of wheels comprises a plurality of locking mechanisms, such that each of the modular front deck section, the first modular side deck section, the second modular side deck section, the fourth modular side deck section, and the rear deck section are separately movable on the plurality of wheels;

locking the plurality of locking mechanisms on the plurality of wheels;

mechanically coupling the first side deck sections to the front deck section;

mechanically coupling the second side deck sections to the first side deck sections;

mechanically coupling the third side deck section to the second side deck sections;

mechanically coupling the fourth side deck sections to the third side deck sections;

mechanically coupling the rear deck sections to the fourth side deck sections;

positioning two sets of stairs to both sides of the front deck section; and mechanically coupling the two sets of stairs to the first side sections and the front deck section, thereby providing access to the modular frame by a user.

11. The method of accessing a mobile piece of mining equipment of claim 10, wherein the accessing is performed to provide maintenance on the mobile piece of mining equipment.

12. The method of accessing a mobile piece of mining equipment of claim 10, wherein the accessing is performed to clean the mobile piece of mining equipment.

13. The method of accessing a mobile piece of mining equipment of claim 10, wherein the accessing is performed to physically inspect the mobile piece of mining equipment.

14. A modular platform system for mounting onto a mobile piece of mining equipment comprising:

a modular frame;

a plurality of ground engaging members supporting the frame, wherein the plurality of ground engaging members further comprises a plurality of wheels with a plurality of locking and unlocking mechanisms, such that each of a modular front deck section, a first modular side deck section, a second modular side deck section, a third modular side deck section, a fourth modular side deck section, and a rear deck section are separately movable on the plurality of wheels; and one or more sets of stairs providing access to the modular frame, wherein the modular frame comprises the modular front deck section with at least one front access location that provides access to the front of the mobile piece of mining equipment;

the first modular side deck section comprising a first side deck with at least one side access location that provides access to the side of the mobile piece of mining equipment, wherein the first modular side deck section is separately movable from the front deck section and mechanically couplable to the front deck section;

the second modular side deck section with at least one side access location that provides access to the side of the mobile piece of mining equipment, wherein the second modular side deck section is separately movable from the first side deck section and mechanically couplable to the first side deck section;

the third modular side deck section with at least one side access location that provides access to the side of the mobile piece of mining equipment, wherein the third modular side deck section is separately movable from the second side deck section and mechanically e couplable to the second side deck section;

the fourth side deck section that is separately movable from the third side deck section and a rear modular deck section and provides a side walkway portion connectable to the third side deck section and the rear deck section; and the rear deck section with at least one rear access location that provides access to the rear of the mobile piece of mining equipment, wherein the rear deck section is separately movable from and mechanically couplable to the fourth side deck section.

15. The modular platform system of claim 14, wherein the front deck section of the modular frame is substantially rectangularly shaped and further comprises a front end that is mechanically coupled to a plurality of safety barriers, two side ends both mechanically coupled to a plurality of safety barriers, and a back end that provides at least one front access location to the front of the mobile piece mining equipment.

16. The modular platform system of claim 14, wherein the rear deck section of the modular frame is substantially rectangularly shaped and further comprises a back end that is mechanically coupled to a plurality of safety barriers, two side ends both mechanically coupled to a plurality of safety barriers, and a front end that provides at least one front access location to the back of the mobile piece mining equipment.

17. The modular platform system of claim 14, wherein the two side deck sections further comprise a plurality of safety barriers that are permanently affixed.

18. The modular platform system of claim 14, wherein the two side deck sections further comprise a plurality of safety barriers that may be removeable by a user.

19. The modular platform system of claim 14, wherein the two side deck sections further comprise one or more escape ladders.

* * * * *